US012606334B2

(12) United States Patent
Deng et al.

(10) Patent No.: US 12,606,334 B2
(45) Date of Patent: Apr. 21, 2026

(54) BARE BOTTLE PRE-GROUPING AND STACKING DEVICE, STACKING METHOD AND PACKAGING APPARATUS

(71) Applicant: GUANGZHOU TECH-LONG PACKAGING MACHINERY CO., LTD, Guangdong (CN)

(72) Inventors: Jianbao Deng, Guangdong (CN); Ling Deng, Guangdong (CN); Fengshun Lei, Guangdong (CN); Huatian Mai, Guangdong (CN)

(73) Assignee: GUANGZHOU TECH-LONG PACKAGING MACHINERY CO., LTD, Guangdong (CN)

( * ) Notice: Subject to any disclaimer, the term of this patent is extended or adjusted under 35 U.S.C. 154(b) by 41 days.

(21) Appl. No.: 18/725,938

(22) PCT Filed: Sep. 28, 2022

(86) PCT No.: PCT/CN2022/122064
§ 371 (c)(1),
(2) Date: Jul. 1, 2024

(87) PCT Pub. No.: WO2024/016476
PCT Pub. Date: Jan. 25, 2024

(65) Prior Publication Data

US 2025/0083848 A1 Mar. 13, 2025

(30) Foreign Application Priority Data

Jul. 19, 2022 (CN) ..... 202210848904.4

(51) Int. Cl.
*B65B 21/00* (2006.01)
*B65B 21/06* (2006.01)
(Continued)

(52) U.S. Cl.
CPC ..... *B65B 21/06* (2013.01); *B65B 21/12* (2013.01); *B65B 35/50* (2013.01)

(58) Field of Classification Search
CPC ..... B65B 21/04; B65B 21/06; B65B 21/12; B65B 35/50; B65G 61/00
See application file for complete search history.

(56) References Cited

U.S. PATENT DOCUMENTS 3,694,993 A * 10/1972 East ..... B65B 21/04 53/247
6,695,569 B2 * 2/2004 Hofer ..... B65G 47/088 414/789.5
(Continued)

FOREIGN PATENT DOCUMENTS

CN 104986381 A 10/2015
CN 204916278 U 12/2015
(Continued)

OTHER PUBLICATIONS

International Search Report issued in PCT/CN2022/122064, mailed Apr. 6, 2023.
(Continued)

*Primary Examiner* — Andrew M Tecco
(74) *Attorney, Agent, or Firm* — Troutman Pepper Locke LLP; Scott D. Wofsy; Gabrielle L. Gelozin

(57) ABSTRACT

A bare bottle pre-grouping and stacking device includes a bottle feeding and conveying mechanism, a grouping and conveying mechanism, a stacking and conveying mechanism, and a pre-grouping mechanism. The bottle feeding and conveying mechanism is configured to transport multiple columns of bare bottles. The grouping and conveying mechanism is disposed downstream of the bottle feeding and conveying mechanism. The stacking and conveying mechanism is disposed at an outlet end of the grouping and conveying mechanism and has the same conveying direction
(Continued)

as the grouping and conveying mechanism. The pre-grouping mechanism includes a mechanical arm and a pre-grouping clamp.

10 Claims, 5 Drawing Sheets

(51) Int. Cl.
*B65B 21/12* (2006.01)
*B65B 35/50* (2006.01)

(56) References Cited

U.S. PATENT DOCUMENTS

| | | | | |
|---|---|---|---|---|
| 7,325,668 | B2 * | 2/2008 | Borsarelli | B65G 47/82 198/430 |
| 8,770,909 | B2 * | 7/2014 | Parker | B65G 57/03 901/41 |
| 2004/0129150 | A1 * | 7/2004 | Lancaster, III | B65G 61/00 99/486 |
| 2009/0000415 | A1 * | 1/2009 | Parker | B65G 57/03 901/41 |
| 2016/0362259 | A1 | 12/2016 | Papsdorf et al. | |

FOREIGN PATENT DOCUMENTS

| | | | | |
|---|---|---|---|---|
| CN | 106314857 | A | 1/2017 | |
| CN | 109552893 | A | 4/2019 | |
| CN | 209382397 | U * | 9/2019 | |
| CN | 110550255 | A | 12/2019 | |
| CN | 110884903 | A | 3/2020 | |
| CN | 113815948 | A | 12/2021 | |
| CN | 215323454 | U | 12/2021 | |
| CN | 216509420 | U | 5/2022 | |
| CN | 216943697 | U | 7/2022 | |
| CN | 115009570 | A | 9/2022 | |
| DE | 4410302 | A1 | 9/1995 | |
| DE | 102004047826 | A1 | 3/2006 | |
| EP | 3445687 | A1 | 2/2019 | |
| EP | 3445687 | B1 * | 1/2021 | B65G 47/086 |
| JP | H04114825 | A | 4/1992 | |
| JP | 2010521386 | A | 6/2010 | |
| JP | 2020070141 | A | 5/2020 | |

OTHER PUBLICATIONS

Office Action issued in Chinese Patent Application No. CN 202210848904.4, mailed Feb. 10, 2023.
Office Action issued in Japanese Patent Application No. JP 2024-553189, mailed Aug. 12, 2025, with English translation.
Bibliographic information for "KPal K5G Bulk Glass Palletizer System", XP93321272, published Jan. 9, 2017.
Extended European Search Report issued in European Patent Application No. EP 22951740.4, mailed Oct. 16, 2025.

* cited by examiner

BARE BOTTLE PRE-GROUPING AND STACKING DEVICE, STACKING METHOD AND PACKAGING APPARATUS

CROSS-REFERENCE TO RELATED APPLICATION(S)

This is a U.S. National Stage Application filed under 37 U.S.C. 371 based on International Patent Application No. PCT/CN 2022/122064, filed Sep. 28, 2022, which claims priority to Chinese Patent Application No. 2022108489044 filed with the China National Intellectual Property Administration on Jul. 19, 2022, the disclosure of which is incorporated herein by reference in its entirety.

TECHNICAL FIELD

The present application relates to the technical field of packaging devices, for example, a bare bottle pre-grouping and stacking device, a stacking method, and a packaging apparatus.

BACKGROUND

Currently, most of the bare bottle pre-grouping and stacking devices in the related art adopt manual stacking, which features high labor costs and low stacking efficiency. For a bare bottle pre-grouping and stacking device adopting mechanized stacking, the clamping jaws can only grab one bottle at a time, and multiple jaws are arranged side by side to grab multiple bottles at a time. For the bare bottle pre-grouping and stacking devices in the related art, the number of bare bottles stacked at each time is small, and the stacking efficiency is low, which cannot meet the needs of a high-speed production line.

Therefore, there is an urgent need for a bare bottle pre-grouping and stacking device to solve the preceding problems.

SUMMARY

A first purpose of the present application is to provide a bare bottle pre-grouping and stacking device with high bare bottle stacking efficiency.

A second purpose of the present application is to provide a bare bottle pre-grouping and stacking method based on the preceding bare bottle pre-grouping and stacking device, which can quickly stack bare bottles and improve stacking efficiency.

A third object of the present application is to provide a packaging apparatus that can achieve high bare bottle stacking efficiency by applying the preceding bare bottle pre-grouping and stacking device.

In a first aspect, a bare bottle pre-grouping and stacking device is provided. The device includes a bottle feeding and conveying mechanism, a grouping and conveying mechanism, a stacking and conveying mechanism, and a pre-grouping mechanism.

The bottle feeding and conveying mechanism is configured to transport a plurality of columns of bare bottles.

The grouping and conveying mechanism is disposed downstream of the bottle feeding and conveying mechanism.

The stacking and conveying mechanism is disposed at an outlet end of the grouping and conveying mechanism and has the same conveying direction as the grouping and conveying mechanism, where the conveying speed of the stacking and conveying mechanism is smaller than the conveying speed of the grouping and conveying mechanism.

The pre-grouping mechanism includes a mechanical arm and a pre-grouping clamp. The pre-grouping clamp is configured to clamp a plurality of rows of the plurality of columns of bare bottles. The mechanical arm is configured to drive the pre-grouping clamp to perform at least one of the translation or rotation within a spatial range to place bare bottles clamped by the pre-grouping clamp on the grouping and conveying mechanism in the stacking direction.

In a second aspect, a bare bottle pre-grouping and stacking method is provided. Based on the preceding bare bottle pre-grouping and stacking device, the method includes the steps below.

A plurality of columns of bare bottles are conveyed using a bottle feeding and conveying mechanism.

A plurality of rows of the plurality of columns of bare bottles are clamped using a pre-grouping clamp.

By using a mechanical arm, the plurality of rows of the plurality of columns of bare bottles clamped by the pre-grouping clamp are placed on a grouping and conveying mechanism in the stacking direction.

In the method, the conveying speed of the grouping and conveying mechanism is greater than the conveying speed of a stacking and conveying mechanism, and under the effect of the difference between the conveying speed of the grouping and conveying mechanism and the conveying speed of the stacking and conveying mechanism, a plurality of groups of bare bottles in rows and columns are capable of being stacked on the stacking and conveying mechanism.

In a third aspect, a packaging apparatus is provided, including the bare bottle pre-grouping and stacking device as described above.

REFERENCE LIST

Figure 1:
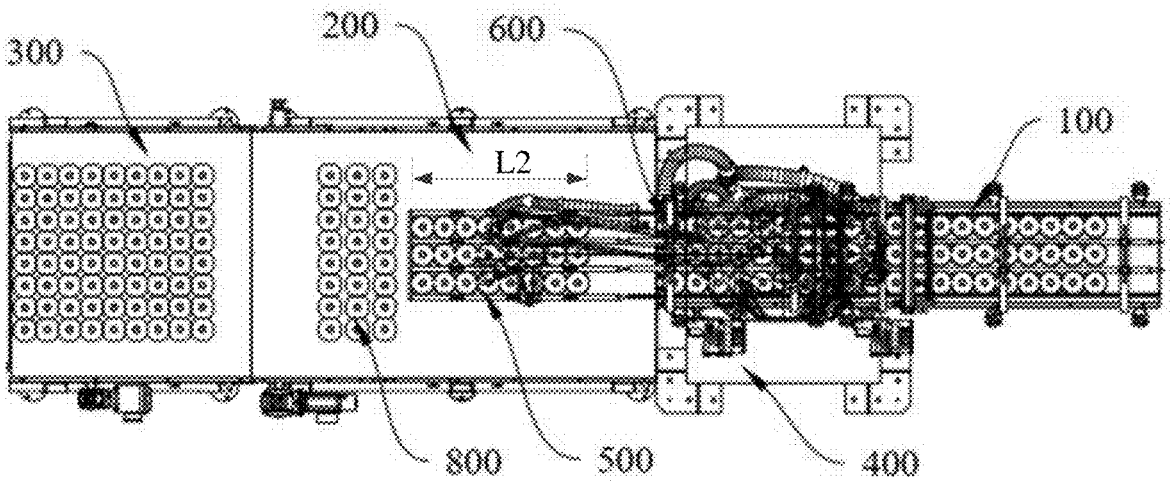
FIG. 1 is a diagram illustrating the structure of an example of a bare bottle pre-grouping and stacking device according to an embodiment of the present application.

100 bottle feeding and conveying mechanism
101 conveyor belt
1011 stacking and conveying portion
1012 flat chain conveying portion
102 guardrail
103 guide plate
104 cross support

200 grouping and conveying mechanism
300 stacking and conveying mechanism
400 mechanical arm
500 pre-grouping clamp
600 bottle-stopping mechanism
700 grabbing and conveying mechanism
800 bare bottle
1 mounting base
11 mounting plate
12 first connection member
13 second connection member
2 clamping mechanism
21 clamping drive member
22 mounting arm
23 crank arm
231 first arm
232 second arm
24 rotating shaft
242 bearing seat
25 clamping plate
251 avoidance slot
3 arrangement mechanism
31 limiting plate
32 partition

DETAILED DESCRIPTION

The technical solutions in embodiments of the present application will be described clearly and completely in conjunction with the drawings in the embodiments of the present application. Generally, the components of embodiments of the present application described and illustrated in the drawings herein may be arranged and designed through various configurations.

It is to be noted that similar reference numerals and letters indicate similar items in subsequent drawings. Therefore, once a certain item is defined in one drawing, the item needs no more definition and explanation in the subsequent drawings.

In the description of the present application, it is to be noted that the orientational or positional relationships indicated by terms "above", "below", "left", "right", "vertical", "horizontal", "inside", "outside", and the like are based on the orientational or positional relationships illustrated in the drawings or the orientational or positional relationship that products of the present application are usually used in. These orientations or position relations are intended only to facilitate and simplify description of the present application and not to indicate or imply that a device or element referred to must have such specific orientations or must be configured or operated in such specific orientations. Thus, these orientations or position relations are not to be construed as limiting the present application. Moreover, terms "first", "second" and "third" are merely for distinguishing the description and are not to be construed as indicating or implying relative importance. In the description of the present application, unless otherwise noted, a term "a plurality of" or "multiple" means two or more.

In the description of the present application, it is to be noted that unless otherwise expressly specified and limited, a term "configured" or "connected" is to be construed in a broad sense, for example, as securely connected, detachably connected or internally connected; or mechanically connected or electrically connected. For those of ordinary skill in the art, meanings of the preceding terms can be understood according to situations in the present application.

Figure 2:
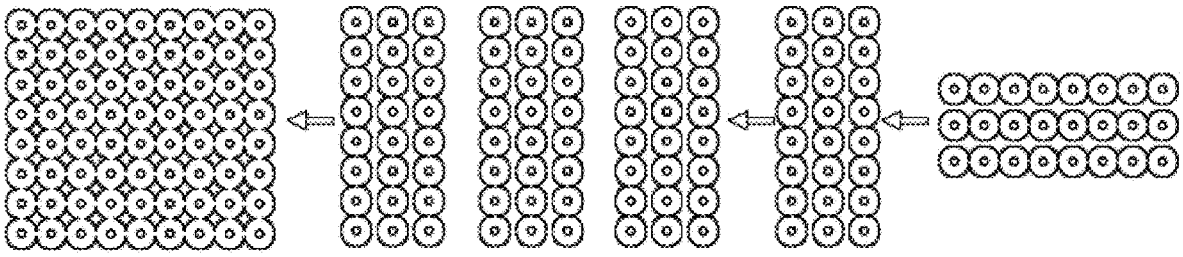
FIG. 2 is a schematic flowchart of the stacking of bare bottles in the bare bottle pre-grouping and stacking device in FIG. 1.

FIG. 1 is a diagram illustrating the structure of an example of a bare bottle pre-grouping and stacking device according to the present application. FIG. 2 is a schematic flowchart of the stacking of bare bottles in FIG. 1. FIG. 1 is a top view of a bare bottle pre-grouping and stacking device. As shown in FIG. 1 and FIG. 2, the bare bottle pre-grouping and stacking device includes a bottle feeding and conveying mechanism 100, a grouping and conveying mechanism 200, a stacking and conveying mechanism 300, and a pre-grouping mechanism. The bottle feeding and conveying mechanism 100 is configured to transport multiple columns of bare bottles 800. The pre-grouping mechanism includes a mechanical arm 400 and a pre-grouping clamp 500. The pre-grouping clamp 500 is configured to clamp multiple rows of the multiple columns of bare bottles 800. The mechanical arm 400 is configured to drive the pre-grouping clamp 500 to perform translation or rotation within a spatial range to place bare bottles 800 clamped by the pre-grouping clamp 500 on the grouping and conveying mechanism 200 in the stacking direction. An inlet end of the grouping and conveying mechanism 200 is connected to an outlet end of the bottle feeding and conveying mechanism 100 and has the same conveying direction as the bottle feeding and conveying mechanism 100. The stacking and conveying mechanism 300 is disposed at an outlet end of the grouping and conveying mechanism 200 and has the same conveying direction as the grouping and conveying mechanism 200. The conveying speed of the stacking and conveying mechanism 300 is smaller than the conveying speed of the grouping and conveying mechanism 200 so that multiple groups of bare bottles 800 in rows and columns on the grouping and conveying mechanism 200 can be stacked on the stacking and conveying mechanism 300.

Illustratively, due to the limited conveying width of the bottle feeding and conveying mechanism 100, the number of rows of the bare bottles 800 clamped by the pre-grouping clamp 500 is greater than the number of columns of the bare bottles 800. In FIG. 1, the row direction of the bare bottles 800 is perpendicular to the conveying direction of the bottle feeding and conveying mechanism 100, and the column direction of the bare bottles 800 is parallel to the conveying direction of the bottle feeding and conveying mechanism. To stack the bare bottles 800 in rows and columns, the mechanical arm 400 may be used to drive the pre-grouping clamp 500 to rotate 90° on the grouping and conveying mechanism 200 so that the arrangement direction of the bare bottles 800 in rows and columns can be adjusted, and under the effect of the difference between the conveying speed of the grouping and conveying mechanism 200 and the conveying speed of the stacking and conveying mechanism 300, the multiple groups of bare bottles 800 in rows and columns can be stacked on the stacking and conveying mechanism 300.

Based on the bare bottle pre-grouping and stacking device shown in FIG. 1, the bare bottle pre-grouping and stacking method includes the steps below.

In S11, multiple columns of bare bottles 800 are conveyed using a bottle feeding and conveying mechanism 100.

In S12, multiple rows and columns of bare bottles 800 are clamped using a pre-grouping clamp 500.

In S13, by using a mechanical arm 400, the multiple rows and columns of bare bottles 800 clamped by the pre-grouping clamp 500 are placed on a grouping and conveying mechanism 200 in the stacking direction. Illustratively, the mechanical arm 400 is used to rotate the pre-grouping clamp 500 by 90° so that the multiple rows and columns of bare bottles 800 are placed on the grouping and conveying mechanism 200 in the stacking direction.

In S14, under the effect of the difference between the conveying speed of the grouping and conveying mechanism 200 and the conveying speed of the stacking and conveying mechanism 300, multiple groups of bare bottles 800 in rows and columns can be stacked on the stacking and conveying mechanism 300.

Figure 3:
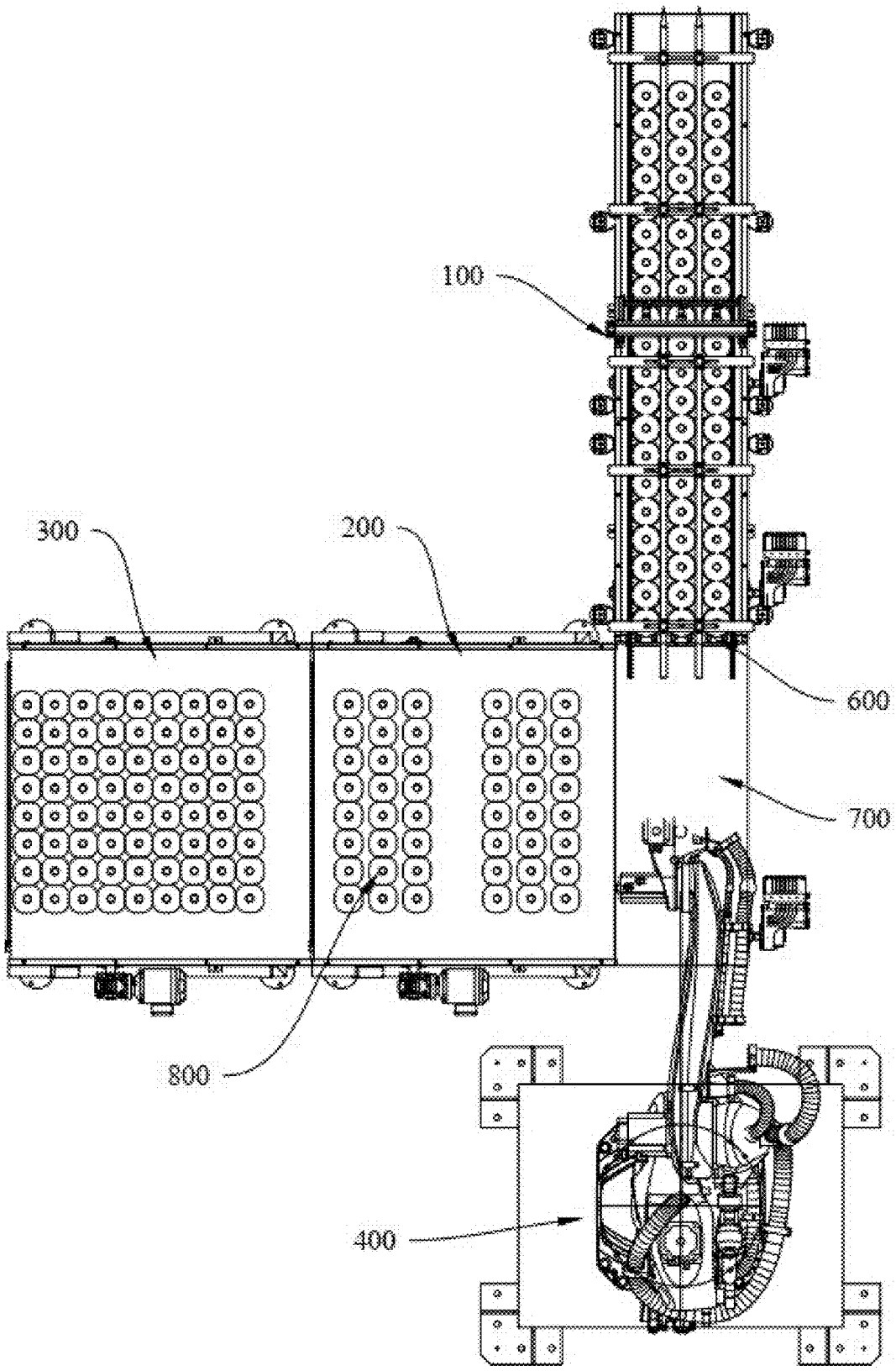
FIG. 3 is a diagram illustrating the structure of another example of a bare bottle pre-grouping and stacking device according to an embodiment of the present application.
Figure 4:
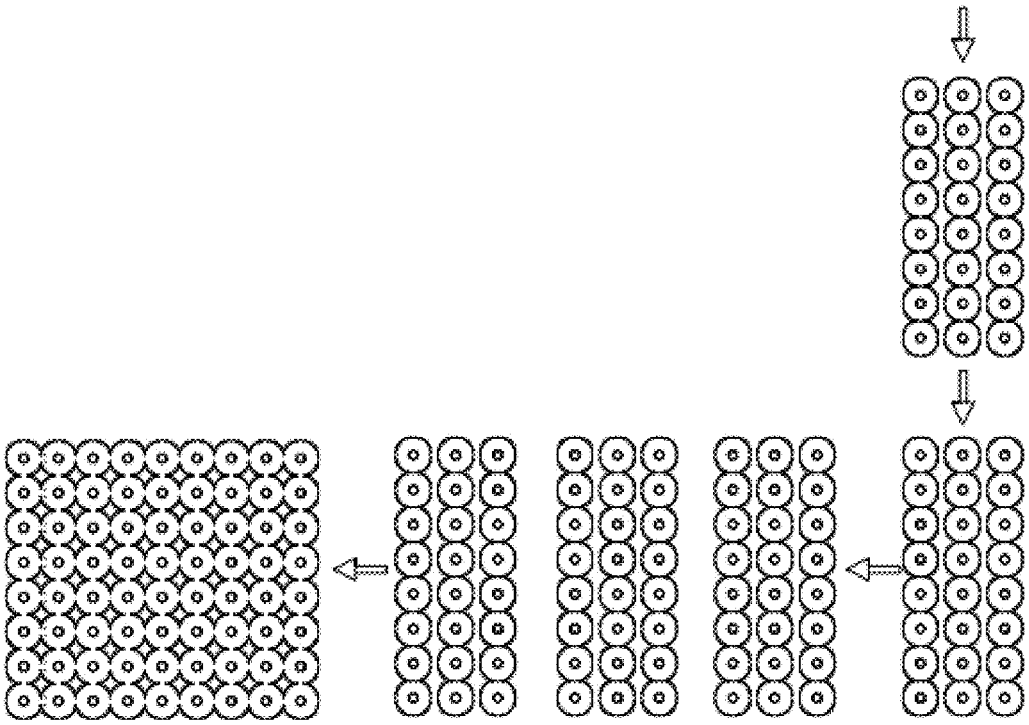
FIG. 4 is a schematic flowchart of the stacking of bare bottles in the bare bottle pre-grouping and stacking device in FIG. 3.

FIG. 3 is a diagram illustrating the structure of another example of a bare bottle pre-grouping and stacking device according to the present application. FIG. 3 is a top view of another example of the bare bottle pre-grouping and stacking device looked down from the air. FIG. 4 is a schematic flowchart of the stacking of bare bottles in FIG. 3. As shown in FIG. 3 and FIG. 4, the bare bottle pre-grouping and stacking device, compared with the preceding bare bottle pre-grouping and stacking device, not only includes a bottle feeding and conveying mechanism 100, a grouping and conveying mechanism 200, a stacking and conveying mechanism 300, and a pre-grouping mechanism but also contains a grabbing and conveying mechanism 700. An inlet end of the grabbing and conveying mechanism 700 is connected to the outlet end of the bottle feeding and conveying mechanism 100 and has the same conveying direction as the bottle feeding and conveying mechanism 100; the inlet end of the grouping and conveying mechanism 200 is connected to the side of the grabbing and conveying mechanism 700. The pre-grouping clamp 500 (not shown in the figures) is disposed on the grabbing and conveying mechanism 700. An open end of the pre-grouping clamp 500 faces the bottle feeding and conveying mechanism 100 to clamp multiple columns of bare bottles 800 conveyed by the bottle feeding and conveying mechanism 100. In addition, the grouping and conveying mechanism 200 is disposed on the side of the grabbing and conveying mechanism 700, and the conveying directions of the two are perpendicular. Therefore, the mechanical arm 400 does not need to rotate the pre-grouping clamp 500 to adjust the direction of the multiple rows and columns of bare bottles 800. Rather, the mechanical arm 400 may be directly used to drive the pre-grouping clamp 500 to translate to the grouping and conveying mechanism 200. Under the effect of the difference between the conveying speed of the grouping and conveying mechanism 200 and the conveying speed of the stacking and conveying mechanism 300, the multiple groups of bare bottles 800 in rows and columns can be stacked on the stacking and conveying mechanism 300.

Based on the bare bottle pre-grouping and stacking device shown in FIG. 3, the bare bottle pre-grouping and stacking method includes the steps below.

In S21, multiple columns of bare bottles 800 are conveyed using a bottle feeding and conveying mechanism 100.

In S22, a pre-grouping clamp 500 is mounted on a grabbing and conveying mechanism 700 and is used to clamp multiple rows and columns of bare bottles 800.

In S23, by using a mechanical arm 400, the multiple rows and columns of bare bottles 800 clamped by the pre-grouping clamp 500 are placed on a grouping and conveying mechanism 200 in the stacking direction. Illustratively, the mechanical arm 400 is used to translate the pre-grouping clamp 500 to drive the multiple rows and columns of bare bottles 800 to be placed on the grouping and conveying mechanism 200 in the stacking direction.

In S24, under the effect of the difference between the conveying speed of the grouping and conveying mechanism 200 and the conveying speed of the stacking and conveying mechanism 300, multiple groups of bare bottles 800 in rows and columns can be stacked on the stacking and conveying mechanism 300.

Illustratively, the mechanical arm 400 may be an ABB or KUKA robot or may be another translation mechanism. The mechanical arm 400 is disposed on a base. For the bare bottle pre-grouping and stacking device in FIG. 1, the base is disposed above the bottle feeding and conveying mechanism 100 or may also be disposed on the side of the bottle feeding and conveying mechanism 100; the mechanical arm 400 is connected to the pre-grouping clamp 500, and the open end of the pre-grouping clamp 500 faces the outlet end of the bottle feeding and conveying mechanism 100. For the bare bottle pre-grouping and stacking device in FIG. 3, the base is disposed on the side of the grabbing and conveying mechanism 700; the mechanical arm 400 is connected to the pre-grouping clamp 500, and the open end of the pre-grouping clamp 500 faces the outlet end of the bottle feeding and conveying mechanism 100.

Figure 5:
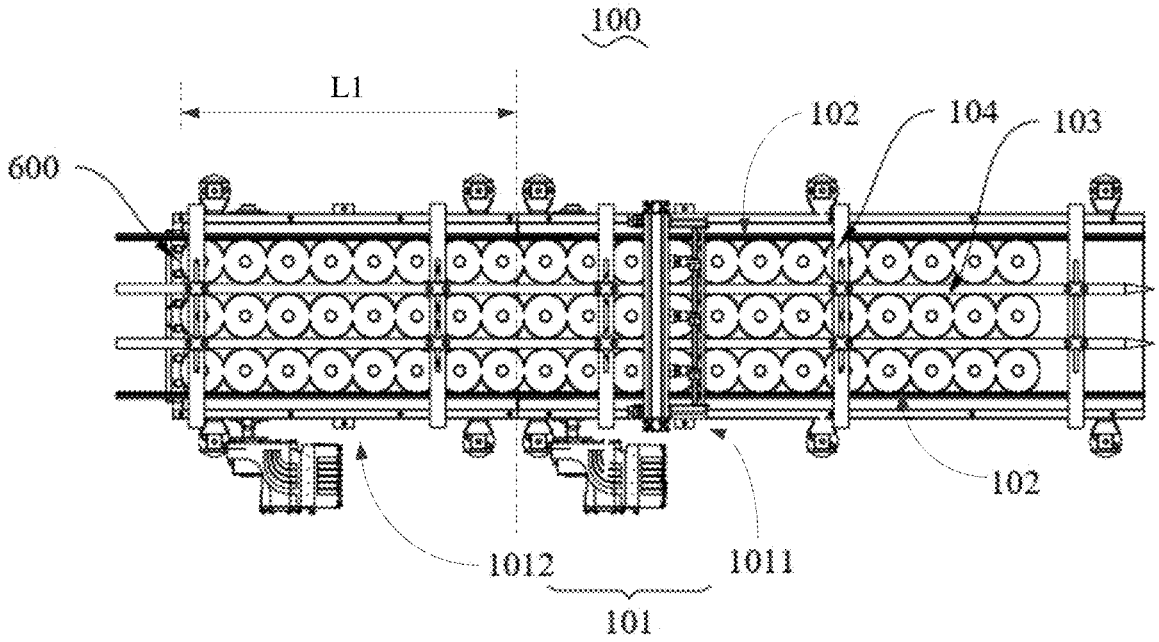
FIG. 5 is a diagram illustrating the structure of a bottle feeding and conveying mechanism according to an embodiment of the present application.

FIG. 5 is a diagram illustrating the structure of a bottle feeding and conveying mechanism 100 according to the present application. As shown in FIG. 5, the bottle feeding and conveying mechanism 100 includes a conveyor belt 101 and a guide assembly, and the guide assembly is configured to separate the conveyor belt 101 into multiple bottle delivery channels to convey multiple columns of bare bottles 800. The conveyor belt 101 includes a stacking and conveying portion 1011 and a flat chain conveying portion 1012 arranged sequentially in the conveying direction. The conveying length L1 of the flat chain conveying portion 1012 is equal to the length L2 of the bare bottles 800 clamped by the pre-grouping clamp 500. The stacking and conveying portion 1011 mainly causes bottles to be arranged close to each other, caches more bottles, and reduces forward pressure. The flat chain conveying portion 1012 mainly plans and stores the number of bottles that need to be grasped by the pre-grouped clamp. The conveying length L1 of the flat chain conveying portion 1012 is the length L2 of the multiple rows of bare bottles 800 that need to be grabbed for storage. The stacking and conveying portion 1011 and the flat chain conveying portion 1012 are two different conveyor belt-shaped components, which together form the conveyor belt 101. In FIG. 5, the guide assembly includes a guardrail 102, a guide plate 103, and a cross support 104; the guardrail 102 and the guide plate 103 extend in the conveying direction of the conveyor belt 101, two guardrails 102 are fixedly located on two sides of the conveyor belt 101, respectively, the cross support 104 is bridged between and fixed on side plates on the two sides of the conveyor belt 101, and several guide plates 103 are fixed on the cross support 104 in parallel and at intervals and suspended above the conveyor belt 101 to form three bottle delivery channels, so as to facilitate simultaneous delivery of bottles by the three channel and improve the efficiency of bottle conveying and arrangement. As shown in FIG. 5, the side plates on the two sides of the conveyor belt 101 refer to the portions outside the guardrails 102. Illustratively, multiple cross supports 104 are fixed to side plates on two sides of the conveyor belt 101 at intervals in the direction of the guardrails 102, and the guide plate 103 is suspended and locked on the cross support 104 through a handle. Certainly, in other embodiments, the upper portion of the conveyor belt 101 may also be divided into multiple bottle delivery channels in other manners, and the number of bottle delivery channels may be designed according to the number of columns that the pre-grouping clamp 500 can clamp.

FIG. 5 is a diagram illustrating the structure of a bottle feeding and conveying mechanism 100 according to the present application. As shown in FIG. 5, to ensure that the pre-grouping clamp 500 can grab multiple columns of bare bottles 800 in a preset row, the bare bottle pre-grouping and stacking device also includes a bottle-stopping mechanism 600; the bottle-stopping mechanism 600 includes a bottle-stopping drive member and a bottle-stopping member, and the bottle-stopping drive member is disposed at the bottom of the outlet end of the bottle feeding and conveying mechanism 100 and is configured to drive the bottle-stopping member to move up and down so that the bottle-stopping member is capable of blocking the outlet end of the bottle feeding and conveying mechanism 100 at a bottle-stopping position and capable of returning below the outlet end of the bottle feeding and conveying mechanism 100 at an avoidance position. In FIG. 5, the bottle-stopping member has a columnar structure, and multiple bottle-stopping members are arranged at intervals to the outlet end of the conveyor belt 101 in the conveying direction perpendicular to the conveyor belt 101, provided that the distance between the bottle-stopping members is less than the width of the bare bottle 800. The bottle-stopping drive member may use a cylinder, an electric cylinder, or a linear motor.

To achieve the automated operation of the bare bottle pre-grouping and stacking device, a first sensor and a second sensor are included. The first sensor is disposed on the conveyor belt 101 and is configured to detect that the flat chain conveying portion 1012 of the conveyor belt 101 is full of bottles in place to facilitate the bottle-stopping mechanism 600 to operate and release the bottles, and all the bare bottles 800 arranged on the flat chain conveying portion 1012 are conveyed to the pre-grouping clamp 500 docked therewith. The number of rows of bare bottles 800 on the flat chain conveying portion 1012 is the same as the number of rows of bare bottles 800 that can be clamped by the pre-grouping clamp 500. The second sensor is disposed on the pre-grouping clamp 500 and is configured to detect whether the pre-grouping clamp 500 is fully loaded. If the pre-grouping clamp 500 is fully loaded, the bottle-stopping mechanism 600 starts to stop bottles. Illustratively, the first sensor may be a photoelectric sensor, and the second sensor may also be a photoelectric sensor. Certainly, in other embodiments, the first sensor may also be another type of sensor, provided that the first sensor can detect that the flat chain conveying portion 1012 is full of bottles. No more examples will be given herein again. The second sensor may also be another type of sensor, provided that the second sensor can detect the pre-grouping clamp 500 is full of bottles. No more examples will be given herein again.

The preceding bare bottle pre-grouping and stacking device can grab bare bottles 800 in multiple rows and columns simultaneously for pre-grouping and stacking, which greatly reduces the number of pre-groupings, reduces the time for stacking bare bottles, and greatly improves the efficiency of pre-grouping and stacking. Moreover, multiple rows of bare bottles directly dock the bottle feeding and conveying mechanism 100; the number of columns of bare bottles 800 that the bottle feeding and conveying mechanism 100 can convey is the number of columns of bare bottles 800 entering the pre-grouping clamp 500. The counting is accurate, and the control is simple. The mechanical arm 400 is used to rotate or translate the pre-grouping clamp 500, whose operation is simple. Compared with the method in the related technology where each clamping claw grabs a bottle, the method is more reliable and stable. Moreover, bottles do not need to be grasped and lifted up, which greatly reduces the error rate and failure rate of dropping the bottle, missing the grip, or misaligned clamping jaws and failure to grasp the bottle.

Figure 6:
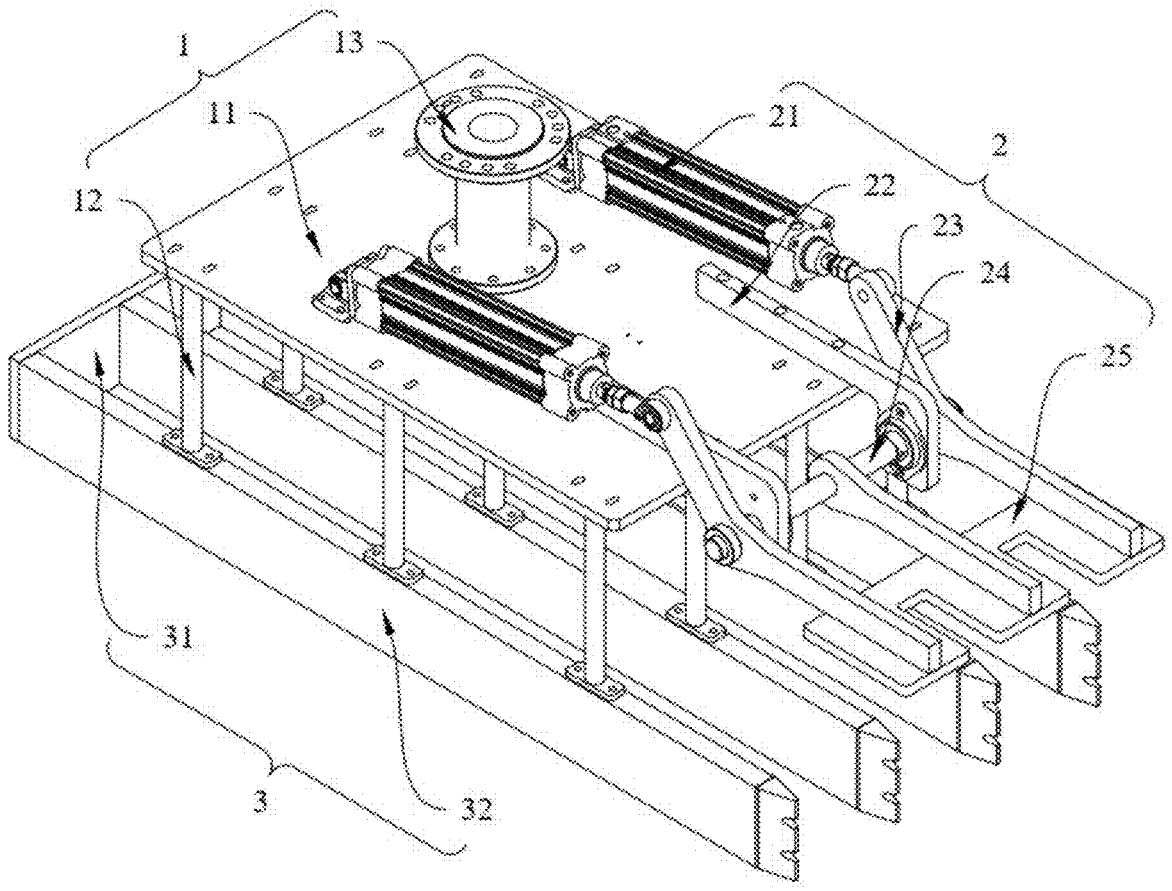
FIG. 6 is a diagram illustrating the structure of a pre-grouping clamp according to an embodiment of the present application.

FIG. 6 is a diagram illustrating the structure of a pre-grouping clamp 500 according to the present application. As shown in FIG. 6, the pre-grouping clamp 500 includes a mounting base 1, an arrangement mechanism 3, and a clamping mechanism 2. The mounting base 1 includes a mounting plate 11, a first connection member 12, and a second connection member 13. The first connection member 12 is configured to connect to the arrangement mechanism 3. The second connection member 13 is configured to be fixedly connected to the mechanical arm 400. The first connection member 12 may be a connection column. The second connection member 13 may be a connection flange. The first ends of multiple first connection members 12 are fixed on the mounting plate 11, and the second ends of the multiple first connection members 12 are fixedly connected to the arrangement mechanism 3. The arrangement mechanism 3 includes a limiting plate 31 and at least two partitions 32. The at least two partitions 32 are fixed on the limiting plate 31 in parallel and at intervals. Bottle clamping space is formed between two adjacent partitions 32. An open end of the bottle clamping space faces the outlet end of the bottle feeding and conveying mechanism 100. Illustratively, the partitions 32 are fixed on the first connection member 12, and each partition 32 is fixedly connected to the mounting plate 11 through multiple first connection members 12. The clamping mechanism 2 includes a drive assembly and a clamping plate 25. The drive assembly is disposed on the mounting plate 11 and is configured to drive the clamping plate 25 to rotate. The clamping plate 25 is capable of being located within the bottle clamping space at a bottle clamping position and capable of being located outside the bottle clamping space at a clamping-waiting position.

Figure 7:
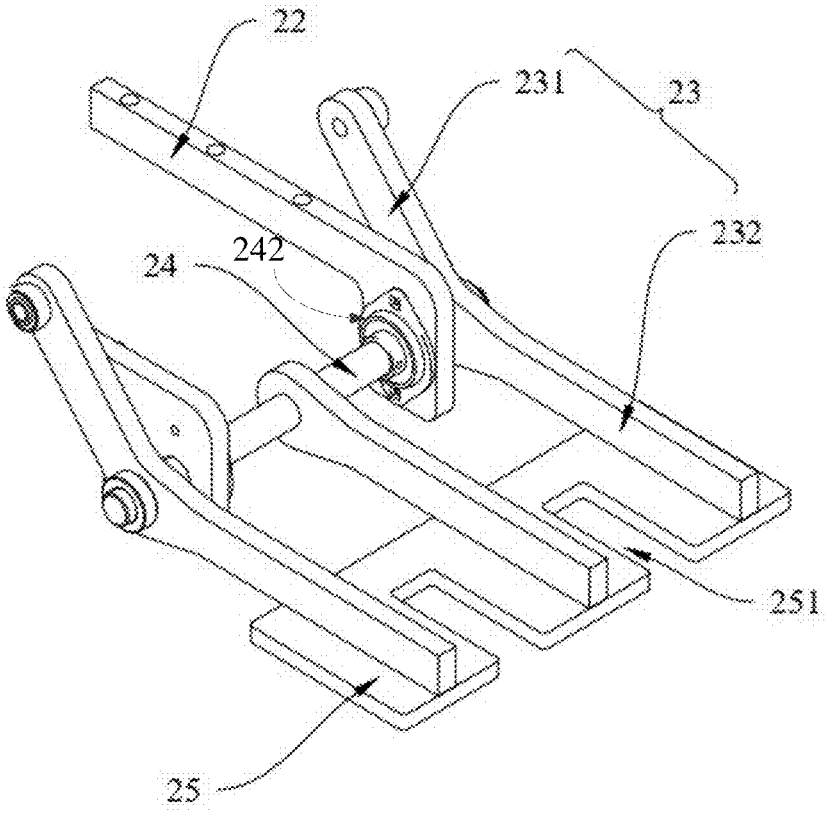
FIG. 7 is a diagram illustrating the structure of a clamping mechanism according to an embodiment of the present application.

In FIG. 6 and FIG. 7, the drive assembly includes a clamping drive member 21, a mounting arm 22, and a crank arm 23; the clamping drive member 21 is disposed on the mounting plate 11, a first end of the mounting arm 22 is fixed on the mounting plate 11, and a second end of the mounting arm 22 is pivotally connected to a bent portion of the crank arm 23 through a rotating shaft 24; a first arm 231 of the crank arm 23 is pivotally connected to an output shaft of the clamping drive member 21, and a second arm 232 of the crank arm 23 is fixedly connected to the clamping plate 25; the clamping drive member 21 is configured to drive the crank arm 23 to rotate around the center of the rotating shaft 24 so that the clamping plate 25 can rotate into the bottle clamping space to cooperate with the limiting plate 31 and the partition 32 to clamp the bare bottle 800, or the clamping plate 25 can rotate to a position parallel to the bottle clamping space so that the bare bottle 800 can enter the bottle clamping space from the opening of the bottle clamping space. The mechanical arm 400 only needs to rotate the pre-grouping clamp 500 on the conveyor belt 101 of the grouping and conveying mechanism 200 or translate the bottles on the conveyor belt 101 of the grabbing and conveying mechanism 700 to the conveyor belt 101 of the grouping and conveying mechanism 200 without the need to hoist the pre-grouping clamp 500. Therefore, the clamping plate 25 may only be used for clamping and positioning, and no greater clamping force is required to prevent the bare bottle 800 from falling.

FIG. 7 is a diagram illustrating the structure of a clamping mechanism 2 according to the present application. As shown in FIG. 7, an avoidance slot 251 is disposed on the clamping plate 25. Illustratively, when the number of partitions 32 is greater than three, the clamping plate 25 is provided with an avoidance slot 251 for accommodating the partitions 32. In FIG. 7, four partitions 32 are provided, and the four partitions 32 form three bottle clamping spaces. The mounting arm 22 and the rotating shaft 24 are rotationally connected through a bearing seat 242 of the mounting arm 22. The crank arm 23 and the rotating shaft 24 are fixedly connected.

The embodiment also provides a packaging apparatus, including the bare bottle pre-grouping and stacking device as described above. By applying the preceding bare bottle 800 pre-grouping and stacking device, the packaging apparatus can pre-group multiple bare bottles 800 to form a stack, thereby quickly improving the efficiency of the bare bottle 800 pre-grouping. Compared with the method in the traditional solution where each clamping claw grabs a bottle, the method is more reliable and stable. Moreover, bottles do not need to be grasped and lifted up, which greatly reduces the error rate and failure rate of dropping the bottle, missing the grip, or misaligned clamping jaws and failure to grasp the bottle. This packaging apparatus can grab bare bottles 800 in multiple rows and columns simultaneously for pre-grouping and stacking, which greatly reduces the number of pre-groupings, reduces the time for stacking bare bottles, and greatly improves the efficiency of pre-grouping and stacking.

Next, an example is used where the bare bottles 800 in eight rows and three columns are grasped once to form the bare bottles 800 formed in nine rows and eight columns which are arranged in groups and stacked. The conveying direction of the bottle feeding and conveying mechanism 100 is the same as the conveying direction of the grouping and conveying mechanism 200. The pre-grouping and stacking process is as follows: Initially, the pre-grouping clamp 500 directly docks the outlet end of the bottle feeding and conveying mechanism 100, the clamping drive member 21 shrinks, and the clamping plate 25 is in a horizontal state to facilitate the entry of bare bottles 800. When the first sensor of the bottle feeding and conveying mechanism 100 detects that bottles are all in place, the bottle-stopping mechanism 600 at the outlet end of the flat chain conveying portion 1012 operates to release the bottles, and the three columns of bare bottles 800 on the flat chain conveying portion 1012 are conveyed into the three bottle clamping spaces of the pre-grouping clamp 500 the flat chain conveying portion 1012 docks with. At the same time, the stacking and conveying portion 1011 of the bottle feeding and conveying mechanism 100 stops the bottle-feeding. When the pre-grouping clamp 500 senses that the last bottle is in place, the clamping drive member 21 drives the clamping plate 25 to extend and rotate around the rotating shaft 24 to a nearly vertical state and then stops. At the same time, the bottle-stopping mechanism 600 resets to stop bottles, and the stacking and conveying portion 1011 starts to continue conveying bottles to the flat chain conveying portion 1012. Then, under the action of the mechanical arm 400, the pre-grouping clamp 500 lifts bare bottles in eight rows and three columns and rotates 90° on the conveyor belt 101 of the pre-grouping and conveying mechanism 200. Then, the mechanical arm 400 is vertically lifted, driving the pre-grouping clamp 500 to slowly separate upward from the bare bottles 800 until the clamp is a certain distance above the top of the bare bottles. The clamping drive member 21 shrinks and drives the clamping plate 25 to rotate and reset around the rotating shaft 24 until a nearly horizontal position is reached. The mechanical arm 400 drives the pre-grouping clamp 500 to quickly move to the outlet end of the bottle feeding and conveying mechanism 100 for docking. At this time, the flat chain conveying portion 1012 of the bottle feeding and conveying mechanism 100 has the full bottle conveying detection in place, and then the second grasp of bare bottles 800 is carried out. Based on this principle, three times of grasp and rotation are performed, and a stacking arrangement format featuring bare bottles 800 in nine rows and eight columns is formed on the stacking and conveying mechanism 300, which greatly improves the efficiency of pre-grouping and stacking.

The bare bottle pre-grouping and stacking device provided by the present application can realize the stacking of multiple groups of bare bottles in rows and columns. The stacking efficiency is high, and the needs of a high-speed production line can be met.

The bare bottle pre-grouping and stacking method provided by the present application, based on the preceding bare bottle pre-grouping and stacking device, can quickly stack bare bottles and improve stacking efficiency.

The packaging apparatus provided by the present application can achieve high bare bottle stacking efficiency by applying the preceding bare bottle pre-grouping and stacking device.

What is claimed is:

1. A bare bottle pre-grouping and stacking device, comprising:

a bottle feeding and conveying mechanism configured to transport a plurality of columns of bare bottles;

a grouping and conveying mechanism disposed downstream of the bottle feeding and conveying mechanism;

a stacking and conveying mechanism disposed at an outlet end of the grouping and conveying mechanism and having a same conveying direction as the grouping and conveying mechanism, wherein a conveying speed of the stacking and conveying mechanism is smaller than a conveying speed of the grouping and conveying mechanism; and a pre-grouping mechanism, comprising a mechanical arm and a pre-grouping clamp, wherein the pre-grouping clamp is configured to clamp a plurality of rows of the plurality of columns of bare bottles, and the mechanical arm is configured to drive the pre-grouping clamp to perform at least one of translation or rotation within a spatial range to place bare bottles clamped by the pre-grouping clamp on the grouping and conveying mechanism in a stacking direction;

wherein the pre-grouping clamp comprises:

a mounting base, comprising a mounting plate fixedly connected to the mechanical arm;

an arrangement mechanism, fixed on the mounting plate and comprising a limiting plate and at least two partitions, wherein the at least two partitions are fixed on the limiting plate in parallel and at intervals, bottle clamping space is formed between two adjacent partitions, and an open end of the bottle clamping space faces an outlet end of the bottle feeding and conveying mechanism; and a clamping mechanism, comprising a drive assembly and a clamping plate, wherein the drive assembly is disposed on the mounting plate and is configured to drive the clamping plate to rotate, and the clamping plate is capable of being located within the bottle clamping space at a bottle clamping position and capable of being located outside the bottle clamping space at a clamping-waiting position.

2. The bare bottle pre-grouping and stacking device of claim 1, wherein the bottle feeding and conveying mechanism comprises a conveyor belt and a guide assembly, and the guide assembly is configured to separate the conveyor belt into a plurality of bottle delivery channels.

3. The bare bottle pre-grouping and stacking device of claim 2, wherein the guide assembly comprises two guardrails, a plurality of guide plates, and a cross support; the two guardrails and the plurality of guide plates all extend in a conveying direction of the conveyor belt, the two guardrails are fixedly located on two sides of the conveyor belt, respectively, the cross support is bridged between and fixed on side plates on the two sides of the conveyor belt, and the plurality of guide plates are fixed on the cross support in parallel and at intervals and suspended above the conveyor belt to form the plurality of bottle delivery channels.

4. The bare bottle pre-grouping and stacking device of claim 3, wherein an inlet end of the grouping and conveying mechanism is connected to an outlet end of the bottle feeding and conveying mechanism and the grouping and conveying mechanism has a same conveying direction as the bottle feeding and conveying mechanism, and the mechanical arm is configured to drive the pre-grouping clamp to rotate 90° on the grouping and conveying mechanism.

5. The bare bottle pre-grouping and stacking device of claim 2, wherein the conveyor belt comprises a stacking and conveying portion and a flat chain conveying portion arranged sequentially in the conveying direction of the conveyor belt, and a conveying length of the flat chain conveying portion is equal to a length of the bare bottles clamped by the pre-grouping clamp.

6. The bare bottle pre-grouping and stacking device of claim 5, wherein an inlet end of the grouping and conveying mechanism is connected to an outlet end of the bottle feeding and conveying mechanism and the grouping and conveying mechanism has a same conveying direction as the bottle feeding and conveying mechanism, and the mechanical arm is configured to drive the pre-grouping clamp to rotate 90° on the grouping and conveying mechanism.

7. The bare bottle pre-grouping and stacking device of claim 2, wherein an inlet end of the grouping and conveying mechanism is connected to an outlet end of the bottle feeding and conveying mechanism and the grouping and conveying mechanism has a same conveying direction as the bottle feeding and conveying mechanism, and the mechanical arm is configured to drive the pre-grouping clamp to rotate 90° on the grouping and conveying mechanism.

8. The bare bottle pre-grouping and stacking device of claim 1, further comprising a bottle-stopping mechanism, wherein the bottle-stopping mechanism comprises a bottle-stopping drive member and a bottle-stopping member, and the bottle-stopping drive member is disposed at a bottom of an outlet end of the bottle feeding and conveying mechanism and is configured to drive the bottle-stopping member to move up and down so that the bottle-stopping member is capable of blocking the outlet end of the bottle feeding and conveying mechanism at a bottle-stopping position and capable of returning below the outlet end of the bottle feeding and conveying mechanism at an avoidance position.

9. The bare bottle pre-grouping and stacking device of claim 8, wherein an inlet end of the grouping and conveying mechanism is connected to an outlet end of the bottle feeding and conveying mechanism and the grouping and conveying mechanism has a same conveying direction as the bottle feeding and conveying mechanism, and the mechanical arm is configured to drive the pre-grouping clamp to rotate 90° on the grouping and conveying mechanism.

10. The bare bottle pre-grouping and stacking device of claim 1, wherein an inlet end of the grouping and conveying mechanism is connected to an outlet end of the bottle feeding and conveying mechanism and the grouping and conveying mechanism has a same conveying direction as the bottle feeding and conveying mechanism, and the mechanical arm is configured to drive the pre-grouping clamp to rotate 90° on the grouping and conveying mechanism.

* * * * *